United States Patent [19]

Johannson

[11] 4,437,609

[45] Mar. 20, 1984

[54] AUTOMATIC DAMPER DEVICE

[75] Inventor: Arne Johannson, Skövde, Sweden

[73] Assignee: Svensk Ideutveckling Handelsbolag, Skövde, Sweden

[21] Appl. No.: 370,162

[22] Filed: Apr. 21, 1982

[30] Foreign Application Priority Data

May 15, 1981 [SE] Sweden ..... 8103068

[51] Int. Cl.[3] ..... F24F 13/10

[52] U.S. Cl. ..... 236/49; 406/12; 414/301

[58] Field of Search ..... 236/49; 222/20, 52, 222/54; 138/46; 406/12, 14, 19; 416/169; 415/123; 414/219, 294, 301, 189

[56] References Cited

U.S. PATENT DOCUMENTS

| | | | |
|---|---|---|---|
| 1,070,470 | 8/1913 | Hixon et al. | 222/20 |
| 2,666,671 | 1/1954 | Kimmerle | 406/12 |
| 2,998,161 | 8/1961 | Quincan | 222/20 |
| 3,028,927 | 4/1962 | Florio | 222/20 |
| 3,250,406 | 5/1966 | Long et al. | 414/219 |
| 4,023,708 | 5/1977 | Fornasari | 222/20 |
| 4,106,670 | 8/1978 | Takeda | 222/20 |
| 4,180,188 | 12/1979 | Aonuma et al. | 414/219 X |

*Primary Examiner*—William E. Tapolcai, Jr.
*Attorney, Agent, or Firm*—Witherspoon & Hargest

[57] ABSTRACT

The damper device of the invention comprises a paddle wheel (2) adapted to allow, by its rotation, the air streaming through the duct (1) wherein the device is mounted. A thermostat (14) senses the temperature in an area immediately upstream the paddle wheel and is adapted to affect a paddle wheel braking device in such a manner that the braking device is caused to brake the paddle wheel to a lesser extent in proportion to the rise of temperature in said area.

6 Claims, 1 Drawing Figure

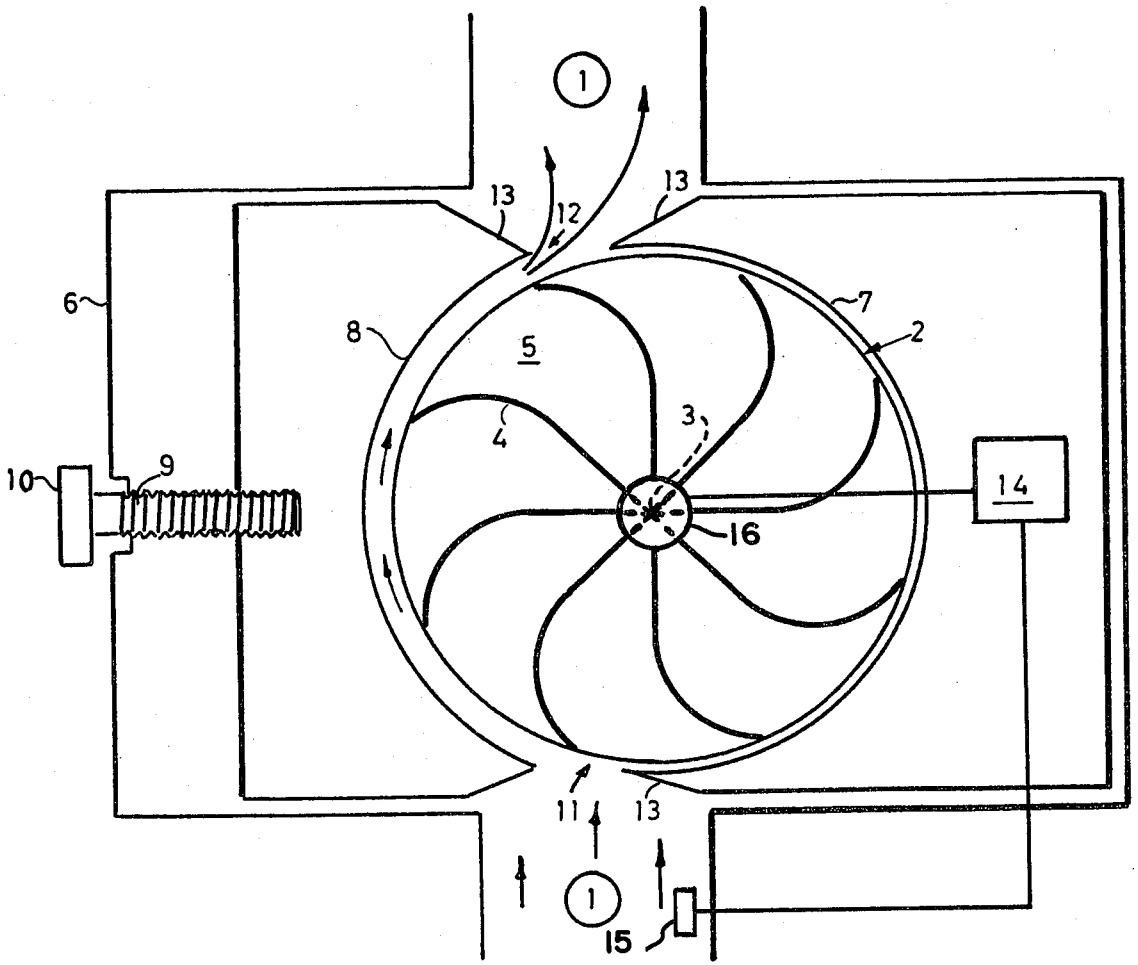
14
2
7
16
3
13
13
15
1
1
12
11
5
4
13
8
9
6
10

AUTOMATIC DAMPER DEVICE

The air flowing through a ventilation installation generally is controlled by means of a damper in the form of a flap operated manually or by means of a motor and rotatable or slidable to allow it to be shifted from a position wherein it completely closes an air duct to a position wherein substantially the whole of the duct cross section is unobstructed for the passage of the air. Such conventional dampers have the disadvantage of hardly being controllable in the sense that they are instantaneously settable in accordance with the ventilation required. This lack of controllability causes considerable energy losses (or unsatisfactory ventilation).

The present invention has for its object a damper device which is automatically controllable according to the instantaneous requirement of ventilation so as to ensure at all times the required ventilation while preventing unnecessary ventilation. This object is met by the damper device of the claims.

The invention is explained in detail in the following description with reference to the attached drawing, the single FIGURE of which being a diagrammatic vertical cross section through an embodiment of the device according to the invention.

It has unexpectedly been found that if the flap of a conventional damper is replaced by a non-driven paddle wheel suitably positioned in the ventilation duct in question a very easily controllable damper is obtained.

The paddle wheel damper according to the invention is primarily intended to be positioned in ventilation installations wherein a certain partial vacuum is ensured, for instance by means of a fan common to several or all apartments of a building. The FIGURE of the drawing shows the device according to the invention located in a ventilation duct in such an installation.

An increase in the need of ventilation is almost always associated with or caused by an increase in the temperature in the premises to be vented. For instance, the need of ventilation is increased by the preparation of food in kitchens, pouring of hot water in bathrooms or an increase in the number of persons in drawing-rooms or other premises etc. All such circumstances and many other situations wherein intensified venting is required result in an increased temperature. A thermostat is therefor used as controlling element in accordance with the invention.

In the embodiment of the invention shown an idling, non-driven paddle wheel 2 is provided in a ventilation duct 1 which for instance may terminate above a stove in a kitchen, shaft 3 of wheel 2 extending transverselly and substantially at right angels to the axis of duct 1. Preferably, paddle wheel vanes 4 are of the type which extend along S-shaped curves across the wheel via a hub about the axis (not shown). Advantageously, vanes 4 may be manufactured from plane, thin sheetmetal strips of predetermined width and bent to the S-shape indicated in the drawing. Preferably the vanes are supported by a pair of side members 5.

In the embodiment shown paddle wheel 2 is mounted in a box 6 inserted between an upper and a lower section of duct 1. The box has top and bottom apertures the diameter of which preferably is equal to the interior diameter of duct 1 so that the interior of box 6 communicates with said two sections of duct 1. The thickness or axial dimension of paddle wheel 2 is equal to or preferably somewhat larger than the diameter of duct 1, and preferably the box is only slightly wider than the axial width of the paddle wheel so that the air is allowed to pass the paddle wheel on the outside of side members 5 to an insignificant degree only. Also, shaft 3 of the paddle wheel is somewhat displaced from the centre line of duct 1, so that air flowing upwardly from the bottom aperture of the box tends to turn the paddle wheel in a predetermined direction. If paddle wheel vanes 5 are of the S-shape shown they are arranged to be convex toward the direction in which, with the above location of the paddle wheel shaft with respect to the centre line of air duct 1, they tend to be rotated by the flow of air rising in the duct.

In addition to the width of box 6 as mentioned above being such in the direction of paddle wheel shaft 3 that the side walls of the box are close to side members 5 of the paddle wheel the space about the paddle wheel in the embodiment shown is limited as well by baffles 7 and 8 which are adapted to cooperate to enclose the major portion of the periphery of the paddle wheel. These baffles may be made from sheet metal. The right baffle 7, as seen in the drawing, very closely encloses substantially one half of the periphery of the paddle wheel and is fixedly secured in box 6. Left baffle 8, on the other hand, is movable towards and away from the paddle wheel periphery by means of a screw 9 supported in the side wall of box 6, the screw being engaged in a thread (not shown) in baffle 8 and being provided with a knob 10. The arrangement described provides for a controllable spacing between baffle 8 and the portion of the periphery of wheel 2 encompassed thereby.

Both baffles 7 and 8 are dimensioned and located such that they define in duct 1 an upper and a lower aperture 11 and 12 the centres of which preferably are on a line which is parallel with the centre line of duct 1 but displaced somewhat therefrom such that it is on the opposite side of the centre line of duct 1 with respect to the plane parallel therewith which contains shaft 3 of paddle wheel 2. This will contribute to the flow of air being directed toward the half of the paddle wheel which one desires to be driven by the stream of air. The stream of air is further directed and controlled by bevellings 13 on baffles 7 and 8 which in duct 1 define throats tapering towards the paddle wheel, these throats, on one hand (lower bevellings 13) directing the stream of air as desired and, on the other hand (upper bevellings 13), reducing the tendency of the air stream of becoming turbulent.

As mentioned, an important feature of the invention is the use of a thermostate for controlling the ventilation, i.e. the stream of air through duct 1. Therefor, according to the invention, a thermostat 14 is positioned in box 6, the thermostat having a sensor member 15 in the portion of duct 1 below paddle wheel 2 and adapted to be responsive to temperature changes in said duct portion to more or less brake or to completely release the paddle wheel, for instance via a friction clutch 16. In the absence of a temperature rise from a predetermined temperature level in duct 1 below the paddle wheel this is completely braked by clutch 16 so that the venting via duct 1 is at a minimum. However, a certain minimum venting may be desirable (or may be compulsory). Such minimum venting is obtained by baffle 8 by means of knob 10 and screw 9 being set such with respect to paddle wheel 2 that the spacing between paddle wheel 2 and baffle 8 becomes large enough to make possible the required minimum venting with the paddle wheel braked. When there is a temperature rise in duct 1 below the paddle wheel thermostate 14 will affect the friction clutch 16 (or other braking device) acting on paddle wheel 2 or shaft 3 thereof so that the paddle wheel can be driven by the stream of air and be allowed to rotate at a rate that is substantially proportional to the rise of temperature in duct 1, this, as is immediately seen, permitting a stream of air in duct 1 via rotating paddle wheel 2 which will increase in proportion to the rise of temperature and which hence will be substantially proportional to the existing venting need.

While only one embodiment has been shown and described, it will be readily apparent to those skilled in the art that various adaptations and modifications thereof may be made within the scope of the invention.

I claim:

1. An automatic damper device for use in a ventilation duct (1) comprising, a paddle wheel (2) positioned in said duct and including a shaft (3) attached to said paddle wheel for attachment to said duct for free rotation relative thereto, said shaft being at right angles to said duct axis;

means (16) coupled to said paddle wheel for controlling the rotation thereof;

a sensor (15) positioned within said duct upstream of said paddle wheel; and, a thermostat (14) coupled to said sensor and said control means whereby said sensor and said thermostat actuate said control means, in response to changes in temperature in said duct.

2. The damper device of claim 1 wherein said shaft (3) is displaced laterally relative to the center line of said duct (1).

3. The damper device of claim 1 or 2 wherein said paddle wheel (2) includes vanes (4) which are of a width which is at least equal to the unobstructed cross section of duct (1), said vanes being straight in directions parallel with the shaft (3) and curved in directions normal thereto such that said vanes are convex in the intended direction of rotation .

4. The damper device of claim 3, characterized in that the paddle wheel (2) is provided in a box (6) inserted into the ventilation duct (1), the box having walls at right angles to the shaft of rotation (3) of the paddle wheel, said walls being closely spaced by a small clearance from the sides of the paddle wheel, baffles (7, 8) being provided within the box, the baffles with a small clearance enclosing the periphery of the paddle wheel with the exception of apertures (11, 12) in the duct adjacent the periphery of the paddle wheel and on the upstream and downstream sides thereof, the centres of said apertures being on a line which is substantially parallel with the centre line of the duct and displaced therefrom to be on the opposite side of the duct axis with respect to the plane parallel therewith and containing the shaft (3) of the paddle wheel.

5. The damper device of claim 4, characterized in that the baffle (8) which is on the opposite side of the centre line of the duct (1) with respect to the shaft (3) of the paddle wheel (2) is adjustable towards and away from the paddle wheel for setting a spacing between the baffle and the paddle wheel permitting a predetermined minimum stream of air through the duct from the upstream side of the paddle wheel to the downstream side thereof when the paddle wheel is braked to the extent that it will not be caused to rotate by the stream of air in the duct.

6. The damper device of the claim 5, characterized in that the baffles (7, 8) are bevelled (13) at the apertures (11, 12) in the duct (1) defined thereby, the bevelling being such that these apertures taper toward the paddle wheel (2).

* * * * *